US010028555B2

(12) United States Patent
Shah et al.

(10) Patent No.: US 10,028,555 B2
(45) Date of Patent: Jul. 24, 2018

(54) JEWELRY MOUNT

(71) Applicants: Neeta Kuldip Shah, Manalapan, NJ (US); Kuldip Shah, Manalapan, NJ (US)

(72) Inventors: Neeta Kuldip Shah, Manalapan, NJ (US); Kuldip Shah, Manalapan, NJ (US)

( * ) Notice: Subject to any disclaimer, the term of this patent is extended or adjusted under 35 U.S.C. 154(b) by 300 days.

(21) Appl. No.: 15/018,853

(22) Filed: Feb. 8, 2016

(65) Prior Publication Data

US 2017/0224067 A1 Aug. 10, 2017

(51) Int. Cl.
*A44C 17/02* (2006.01)
*A44C 27/00* (2006.01)
*A44C 17/04* (2006.01)

(52) U.S. Cl.
CPC ..... *A44C 17/02* (2013.01); *A44C 17/046* (2013.01)

(58) Field of Classification Search
CPC ..... A44C 17/02; A44C 17/04; A44C 17/046
USPC ..... 63/26–28; 29/10, 896.41
See application file for complete search history.

(56) References Cited

U.S. PATENT DOCUMENTS 948,044 A * 2/1910 Fishel ..... A44C 17/02 63/28
7,707,722 B1 * 5/2010 Kothari ..... A44C 17/04 29/10
D643,767 S * 8/2011 Kothari ..... D11/34
D667,335 S * 9/2012 Kothari ..... D11/40
D676,785 S * 2/2013 Kothari ..... D11/40
D751,945 S * 3/2016 Yep ..... D11/92
D753,016 S * 4/2016 Yep ..... D11/92
D754,024 S * 4/2016 Yep ..... D11/92
2006/0107692 A1 * 5/2006 Lindenman ..... A44C 17/04 63/27
2012/0180524 A1 * 7/2012 Wein ..... A44C 17/046 63/28
2013/0227989 A1 * 9/2013 Kothari ..... A44C 17/02 63/28
2014/0215781 A1 * 8/2014 Aghjayan ..... A44C 17/04 29/10
2015/0189957 A1 * 7/2015 Yep ..... A44C 17/046 63/28
2016/0338456 A1 * 11/2016 Yep ..... A44C 17/046
2017/0311686 A1 * 11/2017 Kelley ..... A44C 17/02

* cited by examiner

*Primary Examiner* — Jack W Lavinder

(57) ABSTRACT

A method for setting a central gemstone is disclosed. The central gemstone may be mounted on a triangular cone. The triangular cone may be configured to receive a first tapered end of the central gemstone. Further the method may comprise pressing a lower plate against a top plate. The triangular cone is on the lower plate. Further lapping the central gemstone with a plurality of gemstone, mounted on the top plate, such that plurality of edges of the plurality of gemstone overlap an edge of the central gemstone at broadest diameter in horizontal plane. The method may further comprise soldering a plurality of metal bars, positioned on the periphery of the top plate, with the lower plate at a lower base.

9 Claims, 3 Drawing Sheets

(a)

(b)

JEWELRY MOUNT

CROSS REFERENCE

The present disclosure claims priority from Provisional application having filing No. 62/176,163, filed on Feb. 12, 2015.

TECHNICAL FIELD

The present disclosure relates generally to gemstones and more specifically to a method and apparatus for setting gemstone.

BACKGROUND

In a conventional way a gemstone for example diamond or ruby mounted in a ring is retained using precious metal or other metal as retainers. The retainers help the gemstone from dislocating from its ideal position or falling. However, the use of metal retainer adversely affect the aesthetics of the ring.

SUMMARY

Method and apparatus for setting a gemstone within other gemstone in ring or jewelry is disclosed.

In one implementation of the present disclosure a method for setting a central gemstone is disclosed. The central gemstone may be mounted on a triangular cone. The triangular cone maybe configured to receive a first tapered end of the central gemstone. Further the method may comprise pressing a lower plate against a top plate. The triangular cone is on the lower plate. Further lapping the central gemstone with a plurality of gemstone, mounted on the top plate, such that plurality of edges of the plurality of gemstone overlap an edge of the central gemstone at broadest diameter in horizontal plane. The method may further comprise soldering a plurality of metal bars, positioned on the periphery of the top plate, with the lower plate at a lower base In another implementation of the present disclosure an apparatus for central gemstone is disclosed. The apparatus may comprise a lower plate having a step cut creating a lower base and an upper base. Further a triangular cone mounted on the upper base of the lower plate. The triangular cone may be configured to receive the central gemstone of varying sizes and shapes. The apparatus may further comprise a top plate having a plurality of metal bars extending from outer edge of the top plate. The top plate maybe mounted on the lower plate by soldering the plurality of metal bars with the lower plate at the lower base. Further a plurality of gemstone may be mounted on the top plate such that a plurality of edges of the plurality of gemstone overhang from inner edge of the top plate.

In yet another implementation an apparatus for central gemstone is disclosed. The apparatus comprising a lower plate having a triangular cone mounted on the lower plate. The triangular cone maybe configured to receive the central gemstone of varying sizes and shapes. Further the apparatus may comprise a top plate having a plurality of metal bars extending from outer edge of the top plate. The top plate maybe mounted on the lower plate by soldering the plurality of metal bars with the lower plate at the lower base. Further the lower plate maybe pushed against the top plate. The apparatus may further comprise a plurality of gemstone mounted on the top plate such that a plurality of edges of the plurality of stone overhang from inner edge of the top plate, characterized wherein the plurality of gemstone retain the central gemstone in a defined location with a first surface of the central gemstone and a second surface of the plurality of the gemstones are substantially in same horizontal plane.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to refer like features and components.

DETAILED DESCRIPTION

An apparatus and methods for setting a gemstone in jewelry.

In an exemplary embodiment, according to the present disclosure a gemstone for example diamond may be mounted in a ring using a semi-precious stone to retain the position in the ring. The ring may be fabricated/manufactured wherein the ring may have a lower plate and top plate. The lower plate may have step cut around the periphery of the lower plate. The step cut may create an upper base in the center of the lower plate while a lower base may be created around the periphery. The gemstone like the diamond may be mounted in a cone with triangular geometry. The triangular cone may help keep the tapered base of the gemstone in desired position. Further the top plate having a desired geometric shape like circular or hexagonal or square etc may be used to retain the gemstone from top and falling out. The top plate may act as retainer using the semi-precious gemstone mounted on it. The semi-precious gemstone may over hang over the top plate thus acting as retainer. Further a metal bar extending from the top plate may be used to solder the top plate with the lower plate at the lower base.

Figure 1:
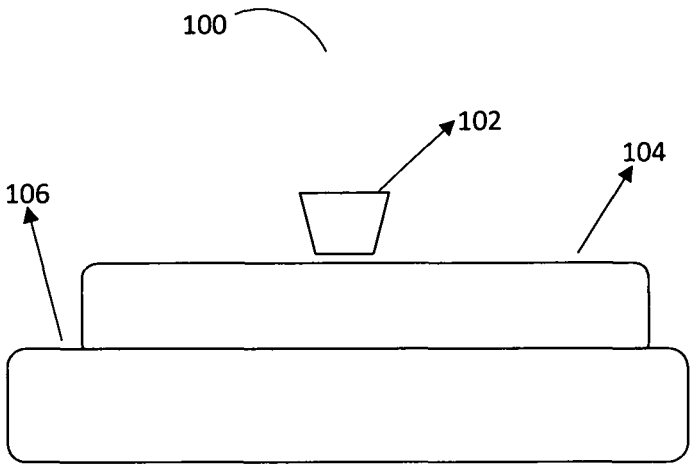
FIG. 1 illustrates a lower plate in accordance with the present disclosure.

FIG. 1 illustrates a lower plate in accordance with the present disclosure. The lower plate 100, may comprise a step cut has illustrated in the figure. Further the lower plate 100 may comprise an upper base 104 and a lower base 106. The lower base 106 may further comprise a cone 102. The cone 102 in an embodiment may have triangular geometry. Further in another embodiment the cone 102, may have any geometric shape as desired. Further the cone 102, may be configured to receive a central gemstone. The central gemstone may be directly mounted on the cone 102.

Figure 2:
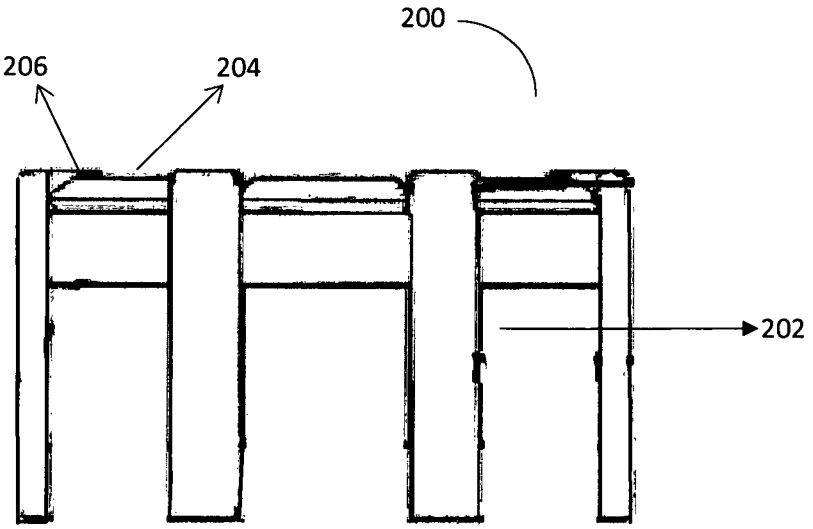
FIG. 2, illustrates a top view and side view of a top plate in accordance with the present disclosure.
Figure 2:
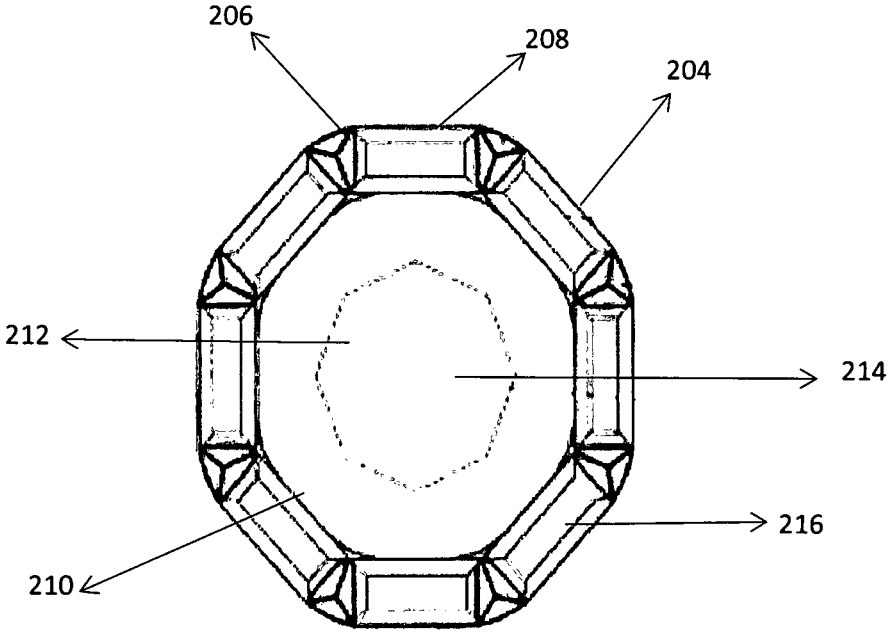

FIG. 2, illustrates a top view and side view of a top plate in accordance with the present disclosure. The top plate 200, in an exemplary embodiment may comprise at least one handle bar 202. The handle bar 202 may enable the top plate 200, to be soldered together with the lower plate, at the lower base. The handle bars 202, may extend from the periphery of the top plate 300 along an outer edge 208. Further the top plate 200, may comprise a plurality of gemstone 204. The plurality of gemstone 204, may be glued or embedded into the top plate 200. The plurality of gemstone may further be held in their desired position using metal insert 206. The plurality of gemstone 204, may be mounted such that they overhang over an inner edge 210, of the top plate 200. The overhang may retain a central gemstone 212, in its pre-defined position or a desired position and may also retain the central gemstone 212 from falling off over top. Further the central gemstone 212 may comprise a first face 214, wherein the first face is always exposed and visible to eyes of an individual, while the plurality of gemstone 204, may comprise a second face 216 visible to the eyes. In another exemplary embodiment the first face 214 and the second face 216 may be substantially in same horizontal plane.

Figure 3:
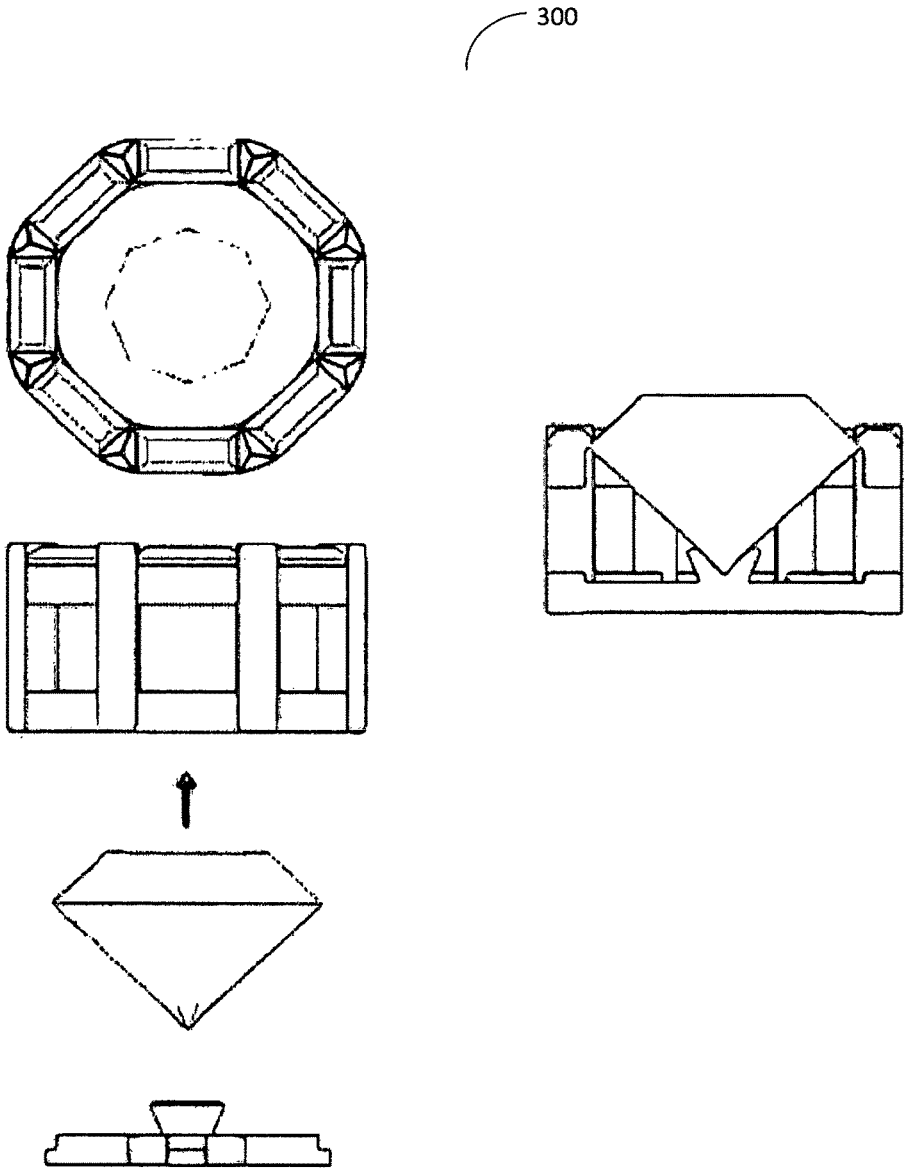
Referring to FIG. 3, illustrates a method in accordance with the present disclosure.

Referring to FIG. 3, illustrates a method in accordance with the present disclosure. The method 300, in an exemplary embodiment discloses a method for setting a central gemstone in a ring. The central gemstone may be mounted on a triangular cone. The triangular cone can be configured to receive a first tapered end of the central gemstone. Further a lower plate comprising the triangular cone with the central gemstone may be pressed against or pushed into a top plate from the bottom. Further as the lower plate is pushed up against the top plate the central gemstone may get overlapped with a plurality of gemstone. The pluralities of gemstone maybe are mounted on the top plate. The pluralities of edges of the plurality of gemstone overlap an edge of the central gemstone at broadest diameter in horizontal plane.

From the foregoing, an apparatus for central gemstone is disclosed, the apparatus comprising, a lower plate having a triangular cone mounted on the lower plate, wherein the triangular cone is configured to receive the central gemstone of varying sizes and shapes, a top plate having a plurality of metal bars extending from outer edge of the top plate, wherein the top plate is mounted on the lower plate by soldering the plurality of metal bars with the lower plate at the lower base, wherein the lower plate is pushed against the top plate, a plurality of gemstone mounted on the top plate such that a plurality of edges of the plurality of stone overhang from inner edge of the top plate, characterized wherein the plurality of gemstone retain the central gemstone in a defined location with a first surface of the central gemstone and a second surface of the plurality of the gemstones are substantially in same horizontal plane.

We claim:

1. A method for setting a central gemstone, method comprising:

mounting the central gemstone on a triangular cone wherein the triangular cone is configured to receive a first tapered end of the central gemstone;

pressing a lower plate against a top plate, wherein the triangular cone is on the lower plate;

lapping the central gemstone with a plurality of gemstones, mounted on the top plate, such that plurality of edges of the plurality of gemstones overlap an edge of the central gemstone at a broadest diameter of the central gemstone in horizontal plane; and soldering a plurality of metal bars, positioned on the periphery of the top plate, with the lower plate at a lower base.

2. The method of claim 1, further comprises gluing the plurality of gemstones on the top plate such that the plurality of edges of the plurality gemstones overhang the top plate.

3. The method of claim 1, wherein the central gemstone is retained between the top plate and the lower plate without glue.

4. An apparatus for receiving a central gemstone, the apparatus comprises:

a lower plate having a step cut creating a lower base and an upper base;

a triangular cone mounted on the upper base of the lower plate, wherein the triangular cone is configured to receive the central gemstone;

a top plate having a plurality of metal bars extending from outer edge of the top plate, wherein the top plate is mounted on the lower plate by soldering the plurality of metal bars with the lower plate; and a plurality of gemstones mounted on the top plate such that a plurality of edges of the plurality of gemstones overhang from an inner edge of the top plate.

5. The apparatus of claim 4, wherein the plurality of gemstones are glued to the top plate.

6. The apparatus of claim 4, wherein the central gemstone further comprises:

a first taper on a bottom side of the central gemstone;

a second taper, wherein the second taper is on top side of the central gemstone at a broadest diameter of the central gemstone in horizontal plane; and a first face adjacent to the second taper.

7. The apparatus of claim 6, wherein the plurality of gemstones further comprises a second face, wherein the second face is always exposed to top viewing side.

8. The apparatus of claim 7, wherein the first face of the central gemstone and the second face of the plurality of gemstones are substantially in same horizontal plane.

9. The apparatus of claim 4, wherein the central gemstone is retained between the top plate and the lower plate by overlap of the plurality of edges over the edge.

* * * * *